US007589584B1

(12) United States Patent
Bui

(10) Patent No.: US 7,589,584 B1
(45) Date of Patent: Sep. 15, 2009

(54) PROGRAMMABLE VOLTAGE REGULATOR WITH DYNAMIC RECOVERY CIRCUITS

(75) Inventor: John Bui, Milpitas, CA (US)

(73) Assignee: Altera Corporation, San Jose, CA (US)

( * ) Notice: Subject to any disclaimer, the term of this patent is extended or adjusted under 35 U.S.C. 154(b) by 633 days.

(21) Appl. No.: 11/096,971

(22) Filed: Apr. 1, 2005

(51) Int. Cl.
*G05F 1/10* (2006.01)
*G05F 3/02* (2006.01)

(52) U.S. Cl. ..... 327/538; 327/535; 327/543; 327/544; 326/33; 326/81

(58) Field of Classification Search ..... 326/31, 326/33, 80–81; 327/143, 260, 250, 534–535, 327/537–541, 543–544, 530; 323/205–211; 713/300, 320
See application file for complete search history.

(56) References Cited

U.S. PATENT DOCUMENTS 5,410,723 A * 4/1995 Schmidt et al. ..... 712/18
5,812,860 A * 9/1998 Horden et al. ..... 713/322
6,034,563 A * 3/2000 Mashiko ..... 327/544
6,177,785 B1 1/2001 Lee
6,232,893 B1 * 5/2001 Cliff et al. ..... 341/78
6,329,874 B1 * 12/2001 Ye et al. ..... 327/544
6,366,224 B2 4/2002 Cliff
6,384,628 B1 * 5/2002 Lacey et al. ..... 326/41
6,453,421 B1 9/2002 Taylor
6,483,165 B2 * 11/2002 Ooishi et al. ..... 257/499
6,523,150 B1 * 2/2003 Buffet et al. ..... 716/4
6,643,162 B2 * 11/2003 Takeuchi et al. ..... 365/145
6,734,716 B2 * 5/2004 Amick et al. ..... 327/530
6,772,356 B1 * 8/2004 Qureshi et al. ..... 713/321
6,801,025 B2 10/2004 Carballo
6,864,708 B2 * 3/2005 Takahashi et al. ..... 326/33
7,142,009 B1 * 11/2006 Watt et al. ..... 326/38
7,276,932 B2 * 10/2007 Kuang et al. ..... 326/33
7,463,057 B1 * 12/2008 Rahim et al. ..... 326/38
2003/0184364 A1 * 10/2003 Miyagi ..... 327/544
2005/0010887 A1 * 1/2005 Bednar et al. ..... 716/8
2006/0119393 A1 * 6/2006 Hua et al. ..... 326/121
2008/0030223 A1 * 2/2008 Arsovski et al. ..... 326/38

* cited by examiner

*Primary Examiner*—Vibol Tan
*Assistant Examiner*—Jason Crawford
(74) *Attorney, Agent, or Firm*—Treyz Law Group; G. Victor Treyz; David C. Kellogg

(57) ABSTRACT

Voltage regulator circuitry is provided. The voltage regulator circuitry is suitable for powering core logic on a programmable logic device. The voltage regulator circuitry receives an external power supply voltage and reduces the external power supply voltage to a core power supply voltage if needed. If the external power supply voltage is at the same level needed to power the core logic, the voltage regulator circuitry passes the power supply voltage to the core logic. The voltage regulator circuitry monitors the core power supply voltage using a feedback path. Overshoot and undershoot fluctuations are minimized. The external power supply voltage may be supplied to a first bus. The core power supply voltage may be distributed on a second bus. A ring of transistors may be used to convey power from the first bus to the second bus. Control circuitry may control the ring of transistors based on programmable setpoint voltages.

25 Claims, 13 Drawing Sheets

| VCCEXT | $V_{2.1}$ | $V_{2.8}$ |
|---|---|---|
| 5.0 | 1 | 1 |
| 3.3 | 1 | 1 |
| 2.5 | 1 | 0 |
| 1.8 | 0 | 0 |
| 1.0 | 0 | 0 |

FIG. 8

PROGRAMMABLE VOLTAGE REGULATOR WITH DYNAMIC RECOVERY CIRCUITS

BACKGROUND OF THE INVENTION

This invention relates to programmable logic device integrated circuits, and more particularly, to voltage regulator circuitry for producing a fixed internal power supply voltage from a range of potential external supply voltages.

Programmable logic devices are a type of integrated circuit that can be customized by a user to implement a desired logic design. In a typical scenario, a logic designer uses a logic design system to design a logic circuit. The logic design system uses information on programmable logic device hardware capabilities to help the designer implement the logic circuit. The logic design system creates configuration data. When the configuration data is loaded into the programmable logic device, it programs the logic of the programmable logic device so that the programmable logic device implements the designer's logic circuit.

Modern high performance programmable logic devices sometimes use multiple power supply voltages. A relatively large power supply voltage (e.g., 3.3 volts) may be used to power input-output circuits at the periphery of the device. Using a large power supply voltage for the input-output circuits ensures that these circuits will be able to operate at high speeds, will be able to interface with high-voltage logic on other chips, and will exhibit good noise tolerance.

A relatively low power supply voltage (e.g., 1.8 volts) may be used to power so-called core logic. The core logic on a programmable logic device generally is located in the center of the device and is operated at a relatively low power supply voltage to ensure high-speed low-power-consumption operation.

Depending on the architecture used for the programmable logic device, the device may also have regions of interface logic that operate at intermediate power supply voltages (e.g., 2.5 volts). This logic may serve as an interface between the low-voltage core logic and high-voltage I/O circuits.

Although there are important performance benefits involved in using multiple power supply voltages in a programmable logic device, some system designers may not be able to easily accommodate complex power supply voltage requirements. For example, if a system is being designed that uses 3.3 volt power for all of its major components, it may be burdensome for the system designer to add extra circuitry to produce a 1.8 volt power supply to accommodate a programmable logic device. Unless the need is great enough, the designer will not be able to justify the additional components for producing the 1.8 volt power supply and will be forced to use a lower-performance programmable logic device that does not require a 1.8 volt supply to operate its core logic.

It would therefore be desirable to be able to provide integrated circuits such as programmable logic devices that do not require special core logic power supply voltages to power their core logic.

SUMMARY OF THE INVENTION

In accordance with the present invention, voltage regulator circuitry is provided that can reduce potentially large external power supply voltage levels to the lower levels used by core logic on a programmable logic device. An external power supply voltage may be connected to a first bus. A core logic power supply voltage may be distributed to core logic using a second bus. The first and second busses may be connected by a ring of n-channel metal-oxide-semiconductor and p-channel metal-oxide-semiconductor transistors.

The ring of transistors may be controlled by control circuitry. The control circuitry may monitor the core logic power supply voltage on the second bus using a feedback path. A voltage reference circuit may be used to generate a reference voltage. A voltage detection circuit may be used to compare the external power supply voltage to voltage levels derived from the reference voltage. A local voltage regulator circuit may produce set point voltages based on the reference voltage. The voltage detection circuit and local voltage regulator may be programmable.

The control circuitry may receive control signals from the voltage detection circuit and set point voltages from the local voltage regulator circuit. The control circuitry may produce control signals for the ring of transistors based on the control signals from the voltage detection circuit, the set point voltages, and the monitored value of the core logic power supply voltage obtained from the feedback path. The set point voltages may be used to establish a target value for the core logic power supply voltage and overshoot and undershoot trip points. When overshoot and undershoot fluctuations are measured in the core power supply voltage, the control circuitry adjusts the ring of transistors accordingly to stabilize the core logic power supply voltage.

The voltage regulator allows programmable logic devices to be used on circuit boards on which there is no separate core logic power supply voltage available.

Further features of the invention, its nature and various advantages will be more apparent from the accompanying drawings and the following detailed description of the preferred embodiments.

BRIEF DESCRIPTION OF THE DRAWINGS

FIG. 8 is a table illustrating logic control signals produced by an illustrative external power supply voltage detection circuit in accordance with the present invention.

DETAILED DESCRIPTION OF THE PREFERRED EMBODIMENTS

The present invention relates to voltage regulators with dynamic regulation capabilities. The voltage regulator circuitry of the present invention may be provided on integrated circuits to allow them to accommodate a range of external power supply voltages. This allows the integrated circuit to include high-performance low-voltage core logic even when a system designer is not able to provide a low-voltage power supply on the board or other system component in which the integrated circuit is installed.

The integrated circuits with low-voltage core logic that are provided with voltage regulator circuitry in accordance with the invention may be, for example, programmable logic device integrated circuits such as programmable logic devices with programmable non-volatile configuration memory. The invention also applies to integrated circuits with programmable capabilities that are not typically referred to as "programmable logic devices." Such programmable integrated circuits may include, for example, application specific integrated circuits with regions of programmable logic, digital signal processors containing programmable logic, microprocessors or microcontrollers with programmable logic regions, etc. Non-programmable versions of the voltage regulator may be used with non-programmable integrated circuits. For clarity, however, the present invention will be described in the context of programmable integrated circuits such as programmable logic devices.

Figure 1:
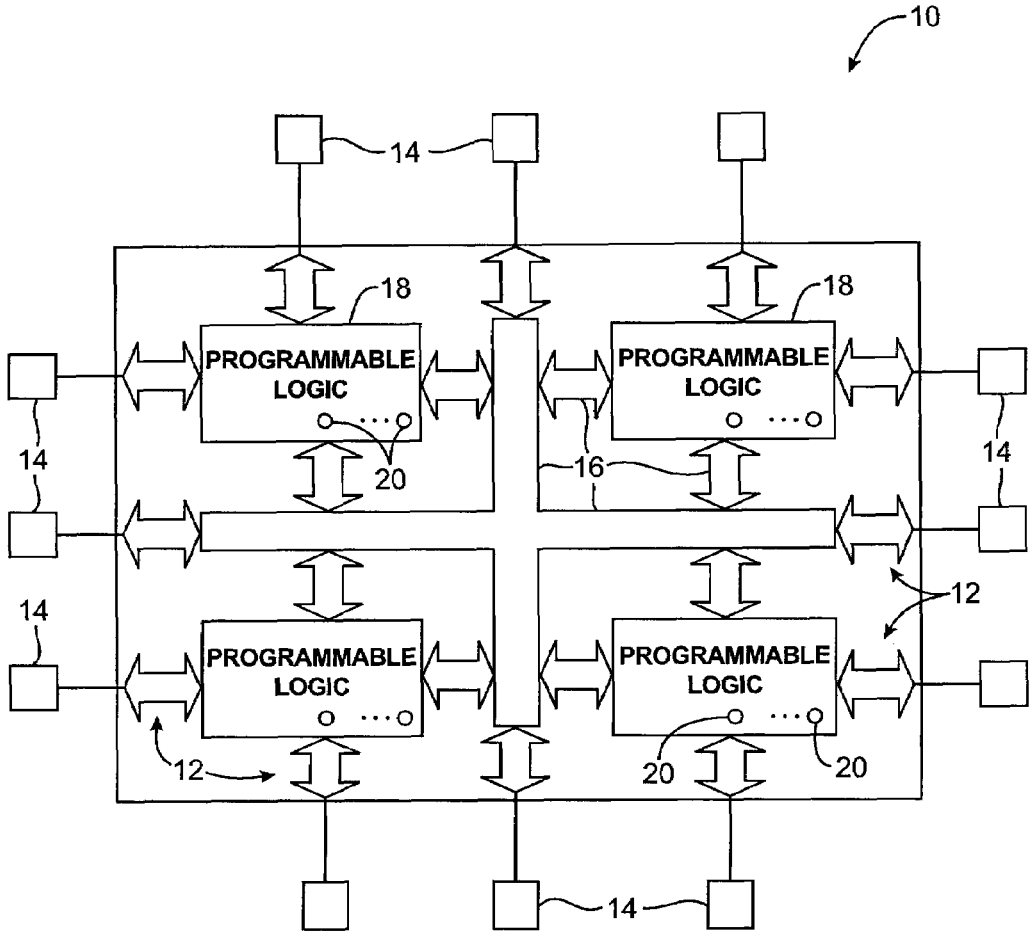
FIG. 1 is a diagram of an illustrative programmable logic device integrated circuit in accordance with the present invention.

An illustrative programmable logic device 10 in accordance with the present invention is shown in FIG. 1. Programmable logic device 10 may have input-output circuitry 12 for driving signals off of device 10 and for receiving signals from other devices via input-output pins 14. Pins 14 may be any suitable types of pins or solder bumps for making electrical connections between the internal circuitry of device 10 and external packaging. Some of the pins 14 may be used for high-speed communications signals. Other pins may be used to provide power supply voltages to the device 10 or may be used for DC or low-frequency signals.

Interconnection resources 16 such as global and local vertical and horizontal conductive lines and busses may be used to route signals on device 10. The remainder of the circuitry 18 on device 10 includes blocks of programmable logic, memory blocks, regions of digital signal processing circuitry, processors, hardwired circuits for supporting complex communications and arithmetic functions, etc. The programmable logic in circuitry 18 may include combinational and sequential logic circuitry including logic gates, multiplexers, switches, memory blocks, look-up-tables, logic arrays, etc. These illustrative components are not mutually exclusive. For example, look-up tables and other components that include logic gates and switching circuitry can be formed using multiplexers.

Some of the logic of programmable logic device 10 is fixed (hardwired). The programmable logic in device 10 includes components that may be configured so that device 10 performs a desired custom logic function. The programmable logic in programmable logic device 10 may be based on any suitable programmable technology. With one suitable approach, configuration data (also called programming data) may be loaded into programmable elements in the programmable logic device 10 using pins 14 and input/output circuitry 12. During normal operation of device 10, the programmable elements (also sometimes called configuration bits or configuration memory) each provide a static control output signal that controls the state of an associated logic component in the programmable logic of circuitry 18.

In a typical volatile arrangement, the programmable elements may be random-access memory (RAM) cells that are loaded from an external configuration device integrated circuit via certain pins 14 and appropriate portions of input/output circuitry 12. The loaded RAM cells provide static control signals that are applied to the terminals (e.g., the gates) of circuit elements (e.g., metal-oxide-semiconductor transistors) in the programmable logic of circuitry 18 to control those elements (e.g., to turn certain transistors on or off) and thereby configure programmable logic device 10. Circuit elements in input/output circuitry 12 and interconnection resources 16 are also generally configured by the RAM cell outputs as part of the programming process (e.g., to customize I/O and routing functions). The circuit elements that are configured in input/output circuitry 12, interconnection resources 16, and circuitry 18 may be transistors such as pass transistors or parts of multiplexers, look-up tables, logic arrays, AND, OR, NAND, and NOR logic gates, etc.

RAM-based programmable logic device technology is merely one illustrative example of the type of technology that may be used to implement programmable logic device 10. Other suitable programmable logic device technologies that may be used for device 10 include one-time programmable device arrangements such as those based on programmable logic elements made from electrically-configured fuses or electrically-configured antifuses, programmable logic devices in which elements 20 are formed from electrically-programmable read-only-memory (EPROM), erasable-electrically-programmable read-only-memory (EEPROM) technology, or flash memory, programmable logic devices with programmable elements made from magnetic storage elements, programmable logic devices with programmable elements made from phase-change materials, mask-programmed devices, etc. Illustrative programmable logic elements are shown schematically as elements 20 in FIG. 1.

The configuration memory of device 10 is preferably provided with configuration data from a user (e.g., a logic designer). A device programmer or configuration device may be used to load the configuration data into device 10. Once provided with appropriate configuration data, the configuration memory will selectively control (e.g., turn on and off) portions of the circuitry in the programmable logic device 10 and thereby customize its functions so that it will operate as desired.

The circuitry of device 10 may be organized using any suitable architecture. As an example, the logic of programmable logic device 10 may be organized in a series of rows and columns of larger programmable logic regions or areas each of which contains multiple smaller logic regions or areas (e.g., areas of logic based on look-up tables or macrocells).

These logic resources may be interconnected by interconnection resources 16 such as associated vertical and horizontal interconnection conductors. Interconnection conductors may include global conductive lines that span substantially all of device 10, fractional lines such as half-lines or quarter lines that span part of device 10, staggered lines of a particular length (e.g., sufficient to interconnect several logic areas), smaller local lines that interconnect small logic regions in a given portion of device 10, or any other suitable interconnection resource arrangement. If desired, the logic of device 10 may be arranged in more hierarchical levels or layers in which multiple large areas are interconnected to form still larger portions of logic. Still other device arrangements may use logic that is not arranged in rows and columns. Portions of device 10 (e.g., in input/output circuitry 12 and elsewhere) may be hardwired for efficiency. As an example, hardwired communications circuitry and digital signal processing circuitry (e.g., multipliers, adders, etc.) may be provided.

Figure 2:
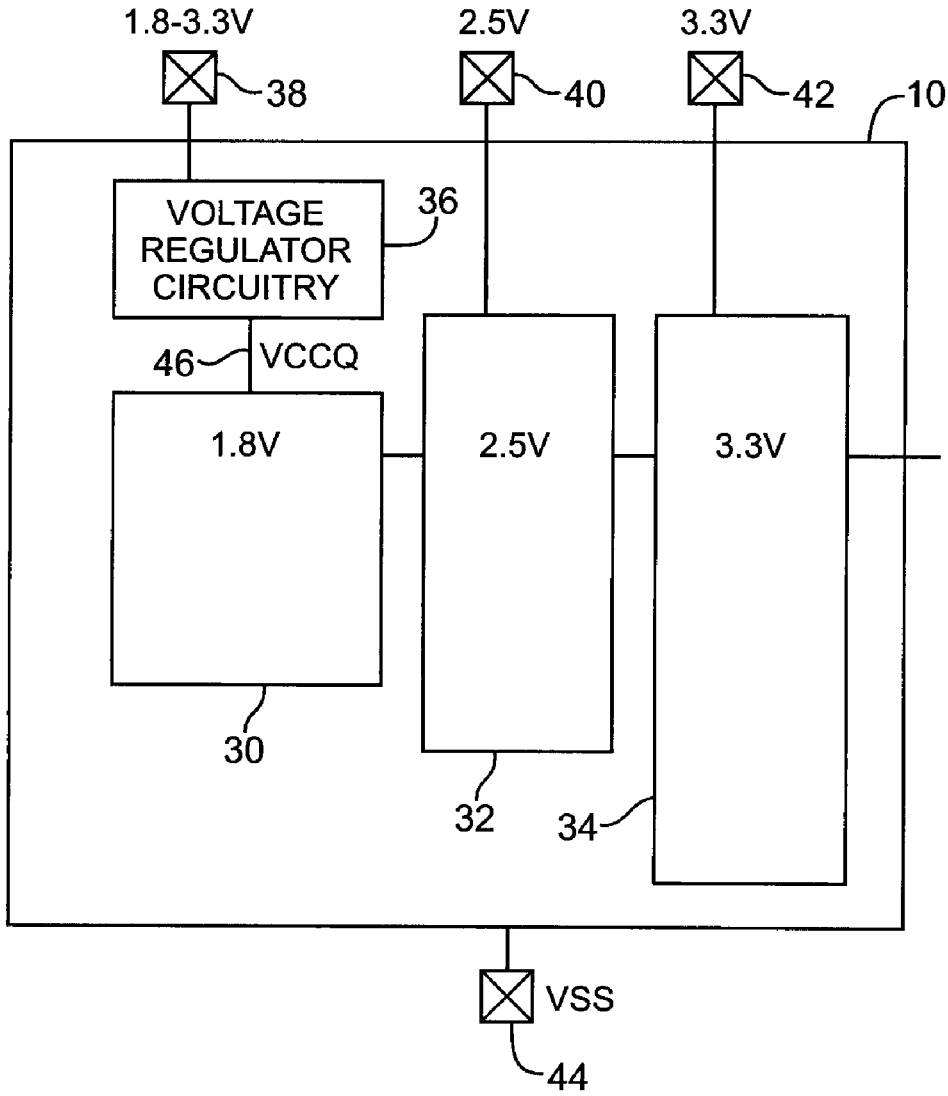
FIG. 2 is a diagram of an illustrative programmable logic device integrated circuit that requires multiple power supply voltages and that uses voltage regulator circuitry to supply one of the power supply voltages from a range of external voltages in accordance with the present invention.

As shown in FIG. 2, device 10 may have regions of circuitry that operate at different power supply voltages. In the example of FIG. 2, circuit region 30 operates at a core logic power supply voltage of 1.8 volts. Circuit region 32 uses a power supply voltage of 2.5 volts. Region 34 operates at a power supply voltage of 3.3 volts.

Device 10 has input-output (I/O) pins. Some of the I/O pins of device 10 are used to convey data. Single-ended and differential I/O buffers may be used to send and receive data signals through these pins. Other I/O pins are used as power supply pins. Pins such as pin 44 may be connected to a source of ground potential (Vss). Pins such as pin 42 may be connected to an external source of power at 3.3 volts. Pins such as pin 40 may be connected to another external source of power (e.g., at 2.5 volts).

It is not always possible for a system designer to provide a power supply voltage low enough for directly powering low-voltage core regions of logic such as region 30. As a result, there is a range of possible power supply voltage levels that may be provided to pins such as pin 38.

If there is a source of low voltage power available (e.g., at 1.8 volts), this source of power may be connected to power supply pins such as pin 38. When voltage regulator circuitry 36 receives low-voltage power supply signals (e.g., at 1.8 volts), the voltage regulator circuitry 36 passes this power supply voltage to circuit region 30. If the external power supply voltage connected to pin 38 is larger (e.g., 3.3 volts), voltage regulator circuitry 36 reduces this voltage until it is at the proper level (e.g., 1.8 volts) for powering the circuitry of region 30. The voltage regulator circuitry 36 contains control circuitry that both statically and dynamically regulates the output power supplied at output 46. This ensures that the voltage received at region 30 is stable and well controlled.

The voltage supply levels shown in FIG. 2 are merely illustrative. Any suitable power supply voltages may be used to power integrated circuit 10. Moreover, there need not be three potentially different power supply levels involved. There may be more than three levels, two levels, or only one level. As an example, device 10 may be powered by a single power supply voltage of 3.3 volts. This power supply voltage level may be used to directly power circuitry such as circuitry 34 (e.g., I/O circuitry and other circuitry that benefits from relatively high power supply voltage levels). The power supply voltage level of 3.3 volts may be regulated to a low level (e.g., 1.8 volts, 1.5 volts, 1.2 volts, 1.1 volts or any other suitable voltage level) by voltage regulator circuitry 36. This lower power supply voltage level, referred to as VCCQ or the core-logic power supply voltage, may be provided to core logic regions and other such regions 30 over path 46.

Figure 3:
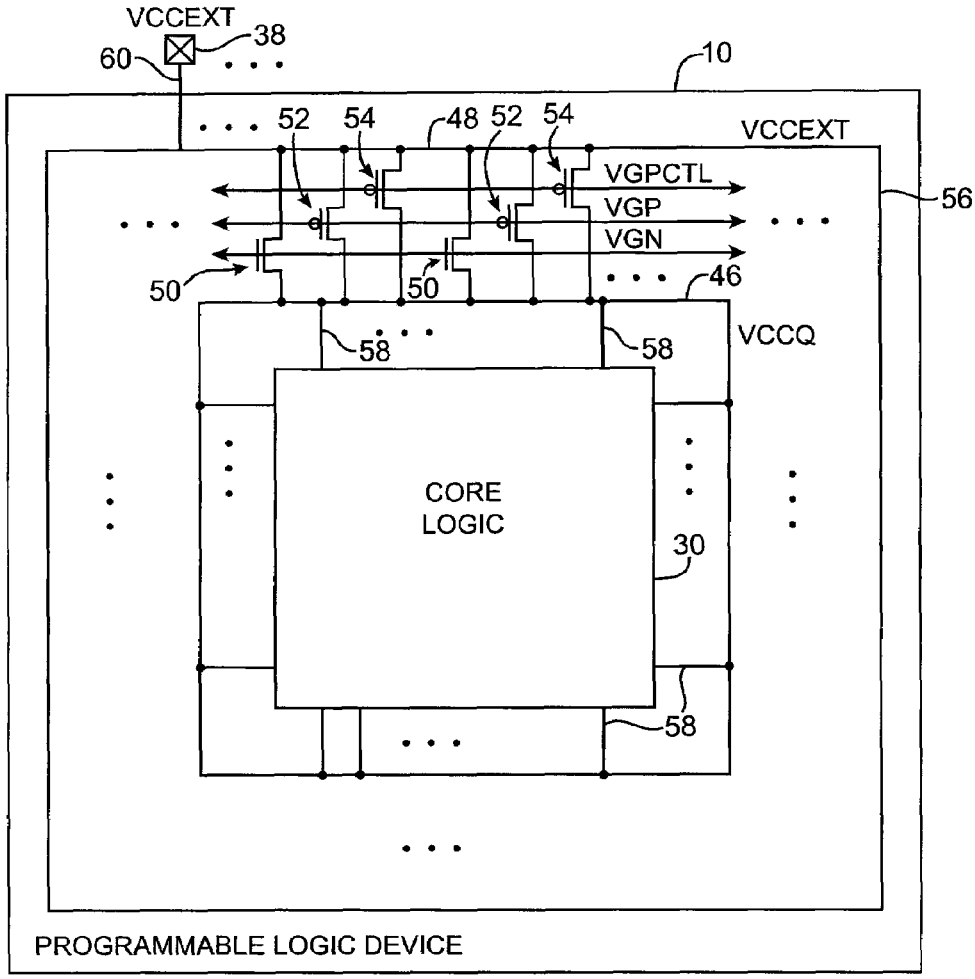
FIG. 3 is a diagram showing how a ring of controlled transistors can be used to connect a high-voltage power supply bus and a low-voltage power supply bus in accordance with the present invention.

Any suitable power distribution arrangement may be used to distribute the voltage VCCQ produced by voltage regulator circuitry 36, provided that current-resistance (IR) losses are not excessive. With one approach, voltage regulator circuitry 36 uses a ring of transistors to regulate and distribute the low-voltage power VCCQ, as shown in FIG. 3. In the illustrative arrangement shown in FIG. 3, an external power supply at VCCEXT is connected to one or more power supply pins 38. These pins may be distributed uniformly over the device 10 (e.g., around the periphery of device 10 if device 10 is a wire-bonded chip or over the surface of device 10 if device 10 uses a solder-ball bonding arrangement). Pins 38 may be connected to a bus line such as bus line 56 via branch conductors 60.

Bus (path) 56 is maintained at a voltage of VCCEXT by virtue of the power supply voltage VCCEXT applied to pins 38. Bus 56 preferably surrounds the periphery of device 10, as shown in FIG. 3. A ring of transistors 50, 52, and 54 is used to connect outer bus 56 to an inner bus 46. The voltage on bus 46 is maintained at a low core logic power supply voltage level VCCQ. Core logic 30 draws power from bus 46 through conductive paths such as branch conductors 58.

Some of the transistors in the ring of transistors between outer bus 56 and inner bus 46 are preferably n-channel metal-oxide-semiconductor (NMOS) transistors such as NMOS transistors 50. Transistors 50 are preferably low-threshold-voltage devices (e.g., native devices) having voltage thresholds $V_{TH}$ of about 0 volts. Other transistors in the ring of transistors are preferably p-channel metal-oxide-semiconductor (PMOS) transistors such as transistors 52 and 54. The illustrative arrangement shown in FIG. 3 has one set of NMOS transistor and two sets of independently-controlled PMOS transistors. This is merely illustrative. For example, there could be three sets or one set of independently-controlled PMOS transistors or more than one set of NMOS transistors.

In the illustrative arrangement shown in FIG. 3, the gates of NMOS transistors 50 are controlled by a control signal called VGN. The gates of the first set of PMOS transistors 52 are controlled by a control signal called VGP. The control signal VGPCTL is used to control the second set of PMOS transistors 54.

Figure 4:
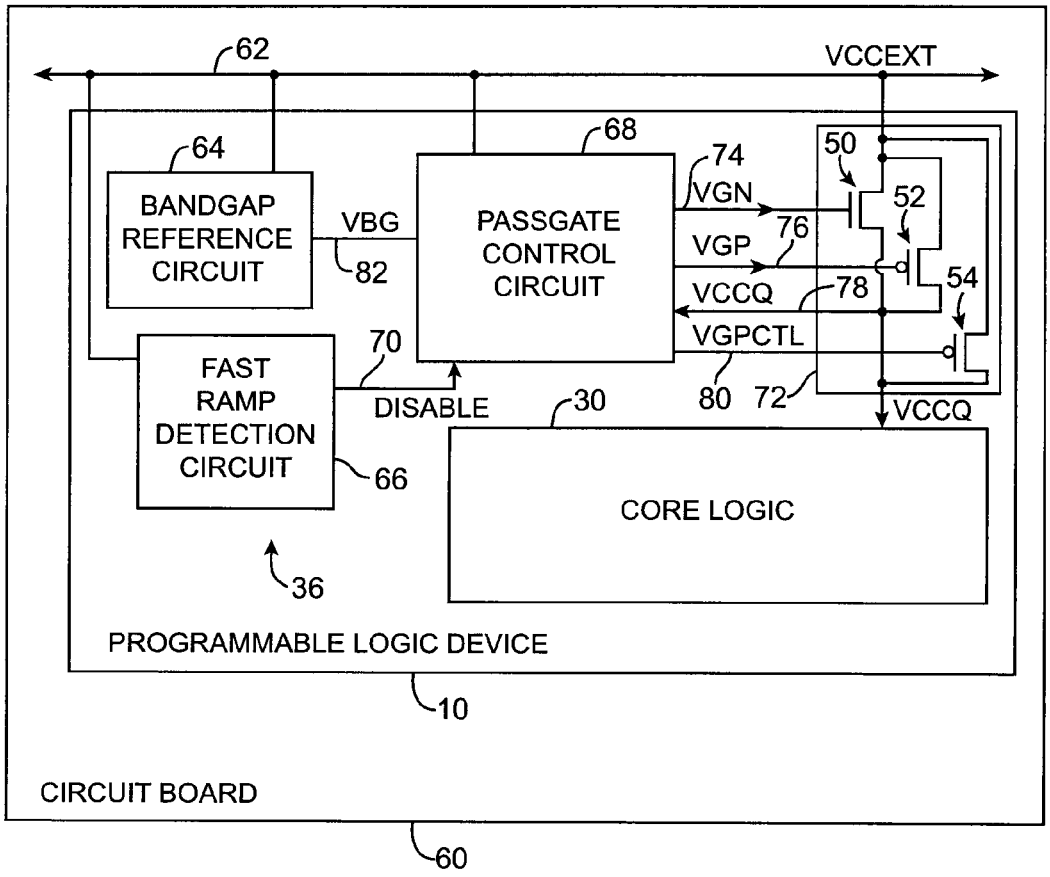
FIG. 4 is a diagram showing the components of an illustrative programmable logic device with a voltage regulator circuit connected to a board-level external voltage supply in accordance with the present invention.

In a typical system environment, programmable logic device 10 is installed on a circuit board such as circuit board 60 of FIG. 4. Boards such as board 60 may be installed in a system rack or other system housing. There are typically power supply busses such as bus 62 on circuit boards. Bus 62 of FIG. 4 distributes the power supply voltage VCCEXT to various pins on programmable logic device integrated circuit 10. Bus 62 also distributes the power supply voltage VCCEXT to other integrated circuits on board 60.

As shown in FIG. 4, voltage regulator circuitry 36 receives the external voltage supply voltage VCCEXT as an input and provides core logic 30 with a corresponding internal power supply voltage VCCQ. With one suitable arrangement, the external voltage VCCEXT may fall within a range of 1.8 volts to about 5 volts and the internal voltage VCCQ may be 1.8 volts. These are merely illustrative voltage levels. Any suitable power supply voltages may be used if desired.

The voltage regulator circuitry 36 includes a bandgap reference circuit 64, a fast ramp detection circuit 66, a passgate control circuit 68, and passgate transistors 72. Bandgap reference circuit is powered by VCCEXT and uses bandgap reference circuitry to produce a reference voltage VBG at output 82. Passgate control circuit 68 receives the reference voltage 82 from bandgap reference circuit 64 and receives the voltage VCCEXT from bus 62. Passgate control circuit controls passgates 72 via control lines 74, 76, and 80. Control line 74 controls the gates of the NMOS transistors 50 using control signal VGN. Line 76 controls the gates of PMOS transistors 52 using the control signal VGP. Line 80 is used to convey the control signal VGPCTL from passgate control circuit 68 to passgate transistors 72. Line 78 provides a feedback path from passgate transistors 72 to passgate control signal 68.

As shown in FIG. 4, the signal VCCQ that is applied to core logic 30 is also conveyed to pass-gate control circuit 68 over feedback path 78. Passgate control circuit 68 monitors the level of VCCQ on line 78 and makes control adjustments to transistors 50, 52, and 54 as needed to ensure that the value of VCCQ is stable and well controlled.

Fast ramp detection circuit 66 monitors the value of VCCEXT as it is applied to the programmable logic device integrated circuit 10 and generates disable control signals for passgate control circuit 68 when VCCEXT has more than a threshold slew rate. When the board 60 powers up, the voltage on bus 62 ramps up from ground (e.g., a VSS value of 0 volts) to full power. If the ramp-up process is relatively slow, the slew rate of the external power supply voltage will be small. In this situation, the fast ramp detection circuit 66 will not generate disable signal on path 70 (e.g., the disable signals will be maintained at a logic low value). If, however, the ramp-up process is fast (e.g., 100 ns), the fast ramp detection circuit 66 will generate temporary disable signals on path 70. These disable signals control gating transistor logic in passgate control circuit 68 and prevent the VCCEXT power supply voltage from being applied to passgate transistors 72 until a predetermined amount of time (e.g., 5-10 microseconds) has passed. By preventing excessively fast ramp-ups in VCCEXT, fast ramp detection circuit 66 prevents overshoot in VCCQ, which helps to avoid damaging device 10.

Figure 5:
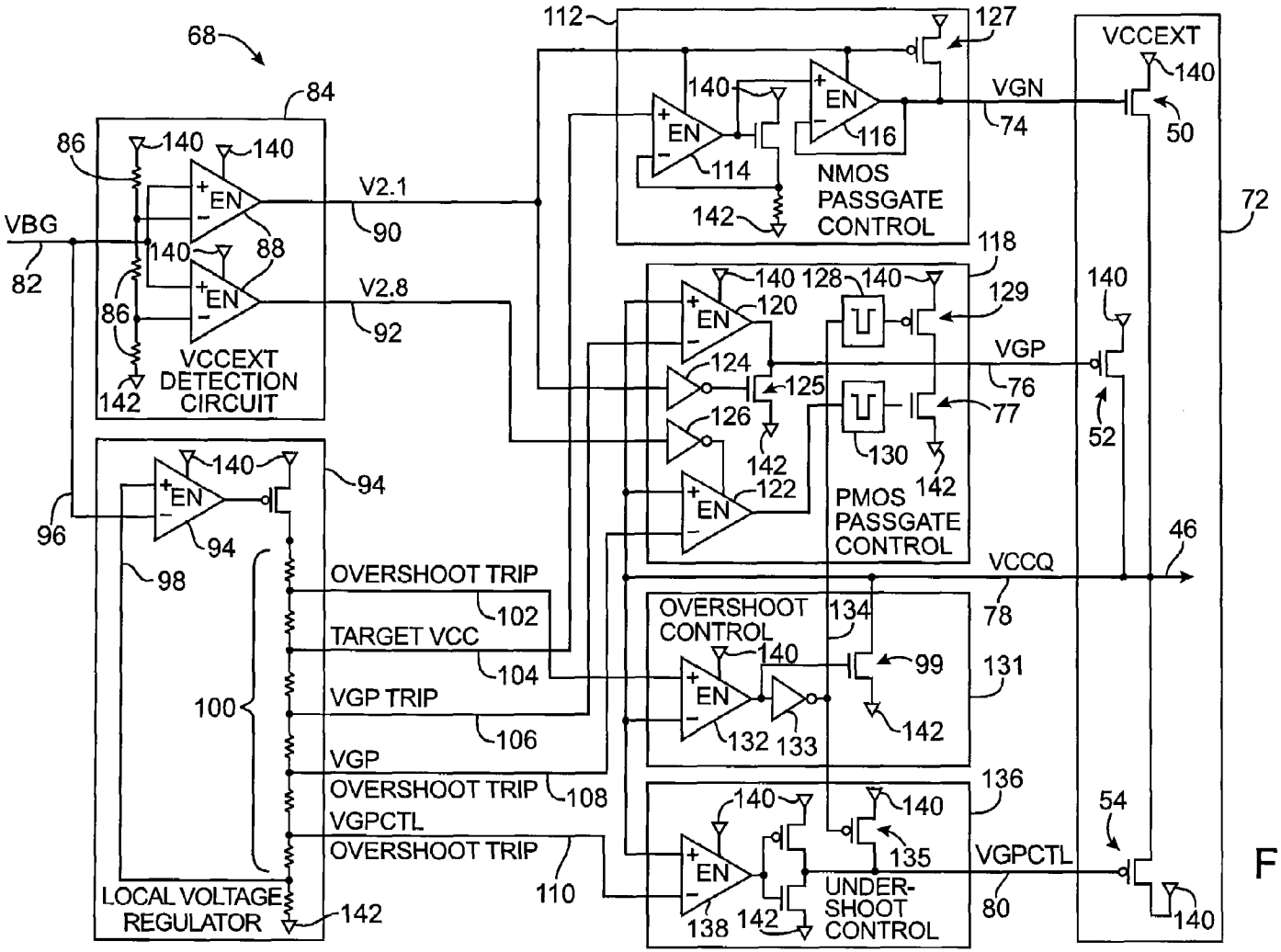
FIG. 5 is a circuit diagram of voltage regulator circuitry for use in providing a core-logic power supply voltage from a range of external power supply voltage levels in accordance with the present invention.

FIG. 5 shows illustrative circuit components that may be used in the passgate control circuitry 68 of voltage regulator circuitry 36. The example of FIG. 5 is merely illustrative. Any suitable circuitry may be used in the circuit components of the voltage regulator if desired.

As shown in FIG. 5, circuitry 68 may include a VCCEXT detection circuit 84. Detection circuit 84 and the other circuits of FIG. 5 receive the voltage VCCEXT via power supply inputs 140 and receive a ground signal VSS at ground terminals 142. The VCCEXT detection circuit 84 has resistors 86 that form a voltage divider circuit. The voltage divider divides the VCCEXT voltage and applies the results to the negative inputs of comparators 88. The positive inputs of comparators 88 receive the reference voltage VBG on line 82 from bandgap reference circuit 64 (FIG. 4). The resulting outputs 90 and 92 of the detection circuit are logic control signals that are indicative of the voltage range in which the power supply voltage VCCEXT lies. The resistors 86 may be fixed or programmable. If resistors 86 are programmable, a user can configure the programmable logic device to recognize different voltage ranges. This modifies the output logic signals that are produced on lines 90 and 92.

The logic signals on lines 90 and 92 are provided to NMOS passgate control circuit 112 and PMOS pass-gate control circuit 118. NMOS passgate control circuit 112 controls the NMOS transistors 50 by applying an appropriate control signal VGN via control line 74. Undershoot control circuit 136 controls the PMOS transistors 54 by applying control signals VGPCTL over line 80. Overshoot control circuit 131 provides signals to PMOS passgate control circuit 118 and undershoot control circuit 136 via line 134 when overshoot conditions are detected in the voltage VCCQ.

Local voltage regulator 94 has a comparator 94 that is connected to voltage divider resistors 100 by feedback path 98. Local voltage regulator 94 receives the reference voltage VBG from line 82 and produces set point signals on lines 102, 104, 106, 108, and 110. If desired, the voltage divider of circuit 94 may be programmable. When circuit 94 is programmable, the values of the set points established on lines 102, 104, 106, 108, and 110 can be adjusted to optimize the performance of circuitry 68.

The set point voltage on line 104 (the signal TARGET VCC) is used to set the desired voltage level for VCCQ. If, for example, it is desired to produce a VCCQ voltage of 1.8 volts for operating low-voltage core logic 30 (FIG. 4), the local voltage regulator 94 is configured to produce a voltage of 1.8 volts on line 104.

Figure 6:
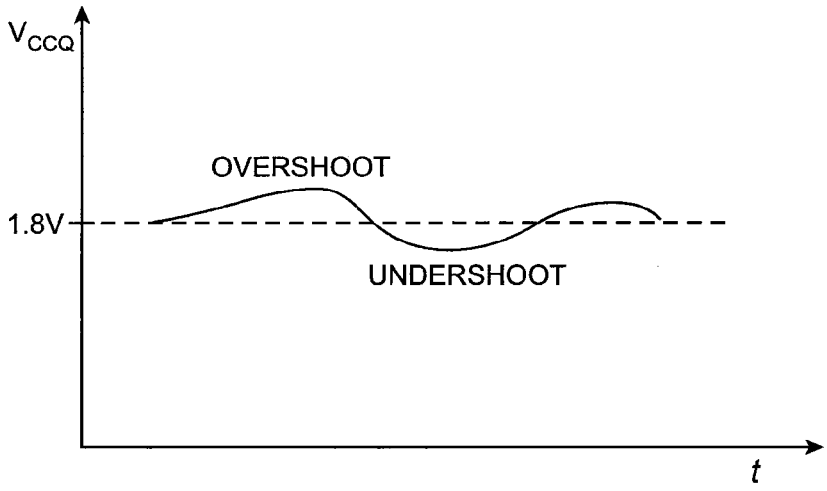
FIG. 6 is a diagram showing how the voltage regulator circuitry of the present invention encounters overshoot and undershoot conditions that must be regulated dynamically in accordance with the present invention.

As illustrated in the graph of FIG. 6, the measured value of VCCQ fluctuates about the setpoint voltage (e.g., 1.8 volts in the example of FIG. 6). Fluctuations in VCCQ above the voltage TARGET VCC are referred to as overshoot. Fluctuations in VCCQ below the voltage TARGET VCC are referred to as undershoot. Overshoot and undershoot may be produced during the normal operation of circuit 10 in which circuitry such as core logic 30 draws varying amounts of power. Passgate control circuit 68 controls pass-gate transistors 72 to ensure that overshoot and undershoot is minimized during operation of circuit 10 despite these destabilizing influences.

The set point voltages on lines 102, 106, 108, and 110 that are produced by local voltage regulator 94 are used to adjust how the passgate control circuit 68 responds to fluctuations in the regulated voltage. Circuit 68 uses line 78 as a feedback path to monitor the value of VCCQ that is being produced by passgates 72. If the measured value of VCCQ exceeds the OVERSHOOT TRIP voltage on line 102, the circuit 68 responds by directing the passgate transistors 72 to reduce the voltage VCCQ. The set point values produced on the lines 106, 108, and 110 control the way in which PMOS passgate control circuit 118 and undershoot control circuit 136 control the PMOS transistors 52 and 54.

NMOS passgate control circuit 112 receives the signal TARGET VCC at the positive input to comparator 114. Comparators 114 and 116 produce a control signal VGN that biases NMOS transistors 50 in an "always on" condition that converts the potentially large VCCEXT voltage on the power supply terminal 140 of passgate transistors 72 into the lower voltage VCCQ on line 46. The voltage of VCCQ produced by the NMOS transistors 50 is the same as the setpoint level established by TARGET VCC on line 104 at the positive input to comparator 114.

Comparators 114 and 116 form a voltage follower buffer that isolates local voltage regulator 94 from signal VGN on line 74. The isolation provided by circuit 112 ensures that noise from NMOS transistors 50 is not coupled back to local voltage regulator 94. The buffer of circuit 112 also increases the drive capacity of the local voltage regulator 94, which might not otherwise be able to control all of the NMOS transistors 50. In a typical scenario there may be 10s or 100s of NMOS transistors 50 and PMOS transistors 52 and 54 to ensure that there is sufficient current carrying capacity between outer bus 56 and inner bus 46 (FIG. 3). The increased drive capacity provided by NMOS passgate control circuit 112 ensures that these transistors can be controlled satisfactorily.

PMOS passgate control circuit 118 has comparators 120 and 122. The positive inputs of comparators 120 and 122 receive VCCQ from feedback path 78. Comparator 120 controls the PMOS transistors 52. When the voltage VCCEXT is close to the desired VCCQ, it may be desirable to turn on the PMOS transistors 52 (sometimes called "helper transistors") to ensure that there is a satisfactory low resistance path between outer bus 56 and inner bus 46 (FIG. 3). When the measured value of VCCQ on line 78 at the negative input to comparator 120 falls below the VGP TRIP set point voltage at the positive input to comparator 120, comparator 120 provides a control signal VGP on line 76 that turns on PMOS transistors 52.

If the monitored value of VCCQ is below VGP TRIP and rises past VGP TRIP, PMOS passgate control circuit 118 will detect this situation and will turn off the helper PMOS transistors 52. Turning off the PMOS transistors 52 in advance of the true set point TARGET VCC helps to improve control and prevents undesirable amounts of overshoot.

To maintain the minimum VCCQ level within the desired operational range, the PMOS transistors 52 are turned on whenever VCCQ is measured to drop below a certain level. For faster recovery, whenever the VCCQ voltage drops below an appropriate set point, transistor 77 is turned on for a short time by an active-high pulse produced by programmable self-regulated pulse generation circuitry in one-shot pulse generator 130. This helps to bring down VGP quickly. This dynamic self-timed one-shot pulse is produced by a programmable delay circuit in generator 130. The maximum pulse width is optimized so that VGP is not pulled too low.

The set point signal VGP UNDERSHOOT TRIP is used to control the application of an additional control signal for helper PMOS transistors 52. As shown in FIG. 5, the VGP UNDERSHOOT TRIP signal on line 108 is applied to the negative input of comparator 122. When the monitored value of VCCQ reaches VGP UNDERSHOOT TRIP, comparator 122 directs one-shot pulse generator 130 to produce a short (e.g., 1 ns) positive pulse that turns on transistor 77 and pulls VGP low, which helps to turn on PMOS transistors 52, which in turn helps to bring VCCQ to the target core-logic voltage level. If there is an early recovery in the VCCQ voltage during the short pulse (i.e., if VCCQ rises past the set point voltage VGP UNDERSHOOT TRIP), the comparator 122 will change states from high to low, which directs the one-shot pulse generator 130 to terminate the pulse early, which in turn ensures that transistor 77 will be turned off quickly. During the early pulse termination, the comparator directs the one-shot pulse generator 130 to override (terminate) the generation of the pulse before the pulse would otherwise terminate. The pulse override process occurs whenever the second bus rises past the undershoot trip set point voltage.

Overshoot fluctuations are handled by overshoot control circuit 131. Overshoot control circuit 131 has a comparator 132 that receives the monitored value of VCCQ at its negative input. The overshoot setpoint OVERSHOOT TRIP that is established on line 102 is applied to the positive input of comparator 132. When an overshoot condition is detected (i.e., VCCQ exceeds OVERSHOOT TRIP), comparator 132 produces a corresponding high control signal. The high control signal at the output of comparator 132 is inverted by inverter 133 to produce a corresponding low control signal on line 134. The low signal on line 134 directs programmable one-shot pulse generator 128 to generate a short active-low pulse for transistor 129 of circuit 118. The active-low pulse (whose duration is regulated by the programmable self-timing circuitry of one-shot pulse generator 128) turns on transistor 129 and pulls VGP rapidly toward VCCEXT. If there is an early recovery in the VCCQ voltage during the short pulse (i.e., if VCCQ falls past the set point voltage OVERSHOOT TRIP), the comparator 132 and associated inverter 133 will change the state of line 134 from low to high, which directs one-shot pulse generator 128 to terminate the pulse early. Terminating the pulse early ensures that transistor 129 will be turned off quickly. This will release VGP to its appropriate level. In terminating the pulse early, the control signal on line 134 produced by comparator 132 and inverter 133 directs the one-shot pulse generator to override (terminate) the generation of the pulse before the pulse would otherwise terminate. The pulse override process occurs whenever the second bus falls below the overshoot trip set point voltage.

When the active-low pulse from one-shot pulse generator 128 turns on transistor 129 and pulls VPP to VCCEXT, the PMOS helper transistors 52 are turned off. Turning PMOS helper transistors 52 off prevents PMOS transistors 52 from contributing to overshoot which could result if PMOS transistors 52 were on and thereby provided a low-resistance pathway between bus 46 and the external power supply voltage VCCEXT. As shown in FIG. 5, the active-low pulse is simultaneously provided to transistor 135 and creates a short positive spike in VGPCTL to ensure that PMOS transistors 54 are also turned off and do not contribute to overshoot. In addition, transistor 99 is turned on by the high-logic-level control signal from comparator 132, which clamps VCCQ at the target VCC level and prevents overshoot. Any suitable number of NMOS transistors 99 may be used in the voltage regulator.

The undershoot control circuit 136 controls the PMOS transistors 54. PMOS transistors 54 supplement the PMOS helper transistors 52 under severe undershoot conditions and therefore can be considered to be supplemental helper transistors. Undershoot control circuit 136 controls transistors 54 based on a different setpoint signal than PMOS passgate control circuit uses to control transistors 52. Staggering the set points and pass-gate transistors in this way provides a more stable control environment for maintaining the desired voltage VCCQ.

Undershoot control circuit 136 has a comparator 138. The positive input of comparator 138 receives the monitored value of VCCQ from line 78. The negative input of comparator 138 receives the setpoint signal VGPCTL UNDERSHOOT TRIP from line 110. Undershoot control circuit 136 takes VGPCTL low when an undershoot fluctuation in VCCQ is detected relative to VGPCTL UNDERSHOOT TRIP. This turns on supplemental helper PMOS transistors 54 to raise VCCQ towards VCCEXT.

The control signals on lines 90 and 92 are used to turn on and off appropriate control circuitry in the regulator circuitry 68, depending on the measured value of VCCEXT. The value of VCCEXT is generally one of the established power supply voltages in common use by system designers (e.g., 3.3 volts, 2.5 volts, 1.8 volts, etc.). Even if one of these voltage levels is used, however, the actual voltage applied to the power supply pins of the programmable logic device integrated circuit will generally be slightly different than the nominal value due to normal variations. Designers often work with specifications that allow power supply voltages to vary as much as 10% from their nominal values. As a result, a power supply that has been designed to provide power at 3.3 volts might in actually be operating at 3.6 volts or 3.0 volts.

Figure 7:
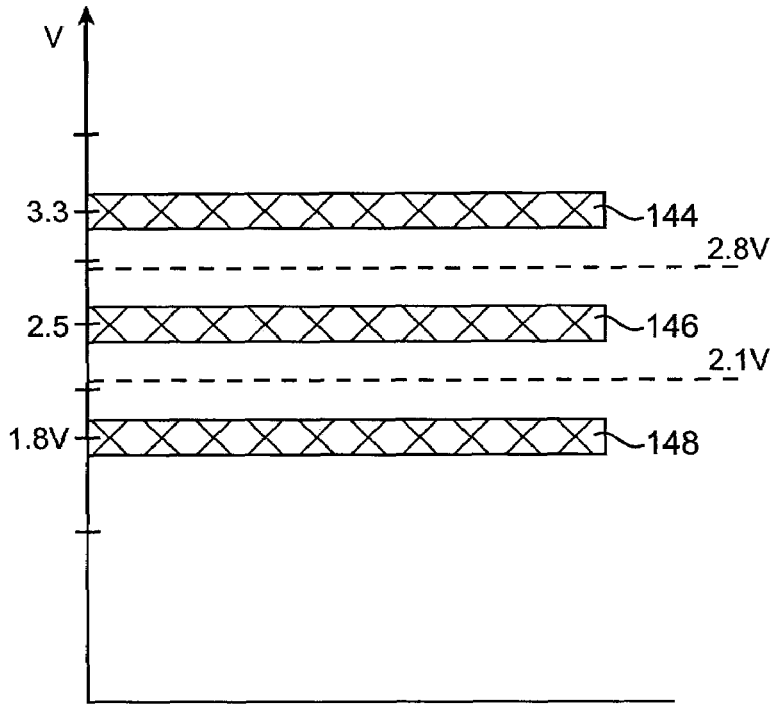
FIG. 7 is a graph showing ranges of common external power supply voltages accommodated by an external power supply voltage detection circuit in accordance with the present invention.

The graph of FIG. 7 illustrates this phenomena. As shown in FIG. 7, a nominal power supply voltage of 3.3 volts might result in an actual power supply voltage within band 144. A power supply that nominally supplies power at 2.5 volts might supply power at a voltage in band 146. Band 148 shows the range of voltages that might be produced in a system in which the nominal power supply voltage level is 1.8 volts.

To improve the performance of the control circuitry of regulator circuitry 68, the VCCEXT detection circuit 84 monitors the actual value of VCCEXT and produces control signals 90 and 92 that reflect the measured value. Any suitable characterization technique may be used by detection circuit 84. In the illustrative embodiment shown in FIG. 5, the circuit 84 categorizes VCCEXT as being 1) above 2.8 volts, 2) being between 2.8 volts and 2.1 volts, or 3) being below 2.1 volts. As shown by the dotted lines in FIG. 7, an advantage of this characterization scheme is that it serves to categorize the common power supply voltage levels (3.3 volts, 2.5 volts, and 1.8 volts) differently, even accounting for their real-world variations from their nominal voltage levels.

The signals on lines 90 and 92 in FIG. 5 are labeled as $V_{2.1}$ and $V_{2.8}$. The values that VCCEXT detection circuit 84 produces for signals $V_{2.1}$ and $V_{2.8}$ for various measured values of VCCEXT are shown in the table of FIG. 8. As shown in FIG. 8, for example, if VCCEXT is below 2.1 volts, both $V_{2.1}$ and $V_{2.8}$ will be low (i.e., a logic zero). If VCCEXT lies between 2.1 volts and 2.8 volts, $V_{2.1}$ will be high (i.e., a logic one) and $V_{2.8}$ will be low. If VCCEXT lies above 2.8 volts, both $V_{2.1}$ and $V_{2.8}$ will be high.

The $V_{2.1}$ control signal on line 90 is supplied to the enable inputs ("EN") of comparators 114 and 116 in NMOS passgate control circuit 112 and the buffer 124 in PMOS passgate control circuit 118. The $V_{2.8}$ control signal on line 92 is supplied to the enable input of comparator 122 via the buffer 126 in PMOS passgate control circuit 118.

In situations such as those illustrated by the forth and fifth rows of the table of FIG. 8, in which VCCEXT is below 2.1 volts, $V_{2.1}$ is low, which biases transistor 127 on, so that the NMOS passgate control circuit 112 can produce a VGN value that is sufficiently high to turn transistors 50 on, despite the low value of VCCEXT. The logic low value of $V_{2.1}$ is inverted by buffer 124 and the logic low value of $V_{2.8}$ is inverted by buffer 126. This turns transistor 125 on and enables buffer 122, thereby taking VGP low. With VGP low, PMOS transistors 52 are on. Turning PMOS transistors 52 on helps ensure that there is a low resistance path from VCCEXT on output bus 56 to VCCQ on inner bus 46 (FIG. 3), even under low VCCEXT conditions. If desired, PMOS transistors 54 can be turned on under these circumstances.

In situations such as those illustrated by the third row of the table of FIG. 8, the value of $V_{2.1}$ is high, which turns off transistor 127 in NMOS passgate control circuit 112 and prevents VGN from becoming too high. Circuit 112 produces a VGN value of TARGET VCC+VT to bias transistors 50 on, where VT is the threshold value of transistors 50. The PMOS passgate transistors are regulated according to the setpoint voltages produced by local voltage regulator 94. For example, the low value of $V_{2.8}$ enables comparator 122, so that an additional control signal can be generated to help turn the PMOS helper transistors 52 on, as described in connection with the VGP UNDERSHOOT TRIP set point.

In situations such as those illustrated by the first and second rows of the table of FIG. 8, the high value of $V_{2.1}$ turns off transistor 127 in NMOS passgate control circuit 112 and prevents VGN from becoming too high. The high value of $V_{2.8}$ disables comparator 122 in PMOS passgate control circuit 118. As a result, no additional control signals will be generated by circuit 118 to help turn on PMOS helper transistors 52 to reduce undershoot. This is appropriate, because at high voltages the PMOS and NMOS passgate devices are already biased in a condition where their drain-source voltages are large and where they can therefore carry a large amount of current. Turning off comparator 122 in these circumstances helps to reduce power consumption by voltage regulator circuitry 68.

Figure 9:
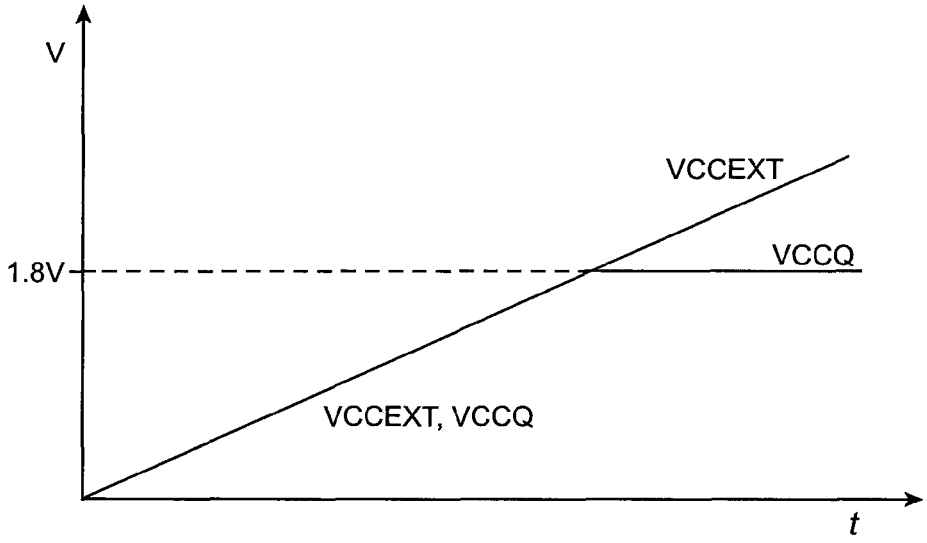
FIG. 9 is a graph showing how the voltage regulator circuitry responds to the application of an external power supply voltage having a low slew rate in accordance with the present invention.
Figure 10:
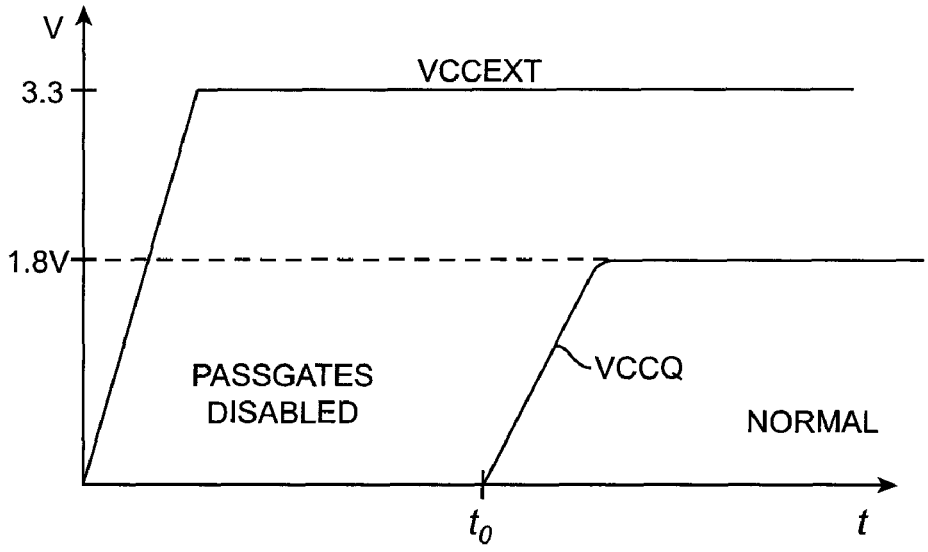
FIG. 10 is a graph showing how the voltage regulator circuitry responds to the application of an external power supply voltage having a slew rate greater than a predetermined threshold slew rate in accordance with the present invention.

Fast ramp detection circuitry 66 of FIG. 4 ensures that the voltage VCCEXT that is applied to passgate transistors 72 does not rise too rapidly. If VCCEXT rises relatively slowly, as shown in FIG. 9, the value of VCCEXT and VCCQ will be the same until VCCEXT reaches VCCQ TARGET (1.8 volts in the example of FIG. 9). If, however, VCCEXT rises rapidly, fast ramp detection circuit 66 will detect this rapid rise and will issue a disable signal on line 70 that instructs passgate control circuit 68 to disable passgates 72. This condition is maintained until a suitable amount of time has elapsed (e.g., a time $t_0$ of about 5 microseconds). As shown in FIG. 10, at time $t_0$, the fast ramp detection circuit 66 releases the disable signal so that the passgate control circuit 68 can operate normally. By preventing the overly-rapid application of VCCEXT to the passgate transistors 72, the fast ramp detection circuit 66 helps to prevent circuit damage or instability that might otherwise result when VCCEXT changes quickly (e.g., when a board is plugged into a system rack).

As described in connection with FIG. 5, it may be desirable to adjust settings for circuitry 68. For example, it may be desirable to adjust the categorizing voltage levels used by VCCEXT detection circuit 84 or the setpoint voltages produced by local voltage regulator 94. If desired, these adjustments may be made by using programmable circuits in place of fixed resistors such as resistors 86 and 100.

Figure 11:
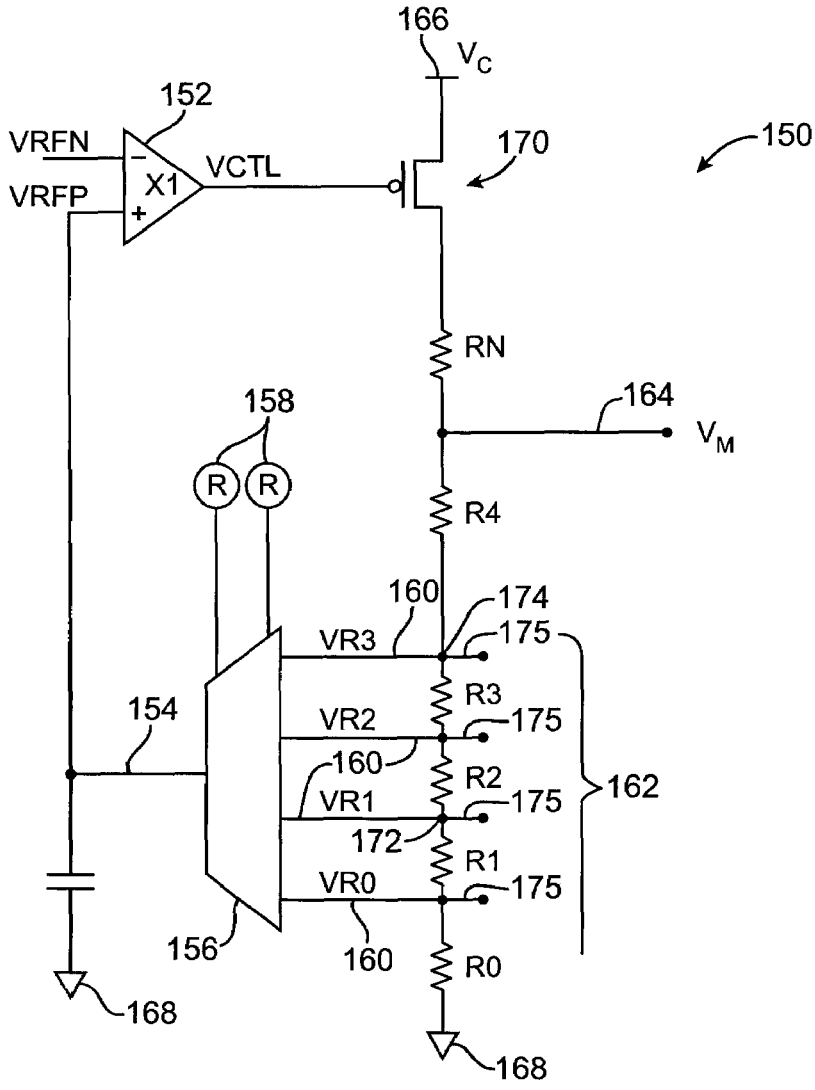
FIGS. 11, 12 and 13 are circuit diagrams of illustrative programmable resistor circuits that may be used to program the voltage regulator circuitry in accordance with the present invention.
Figure 12:
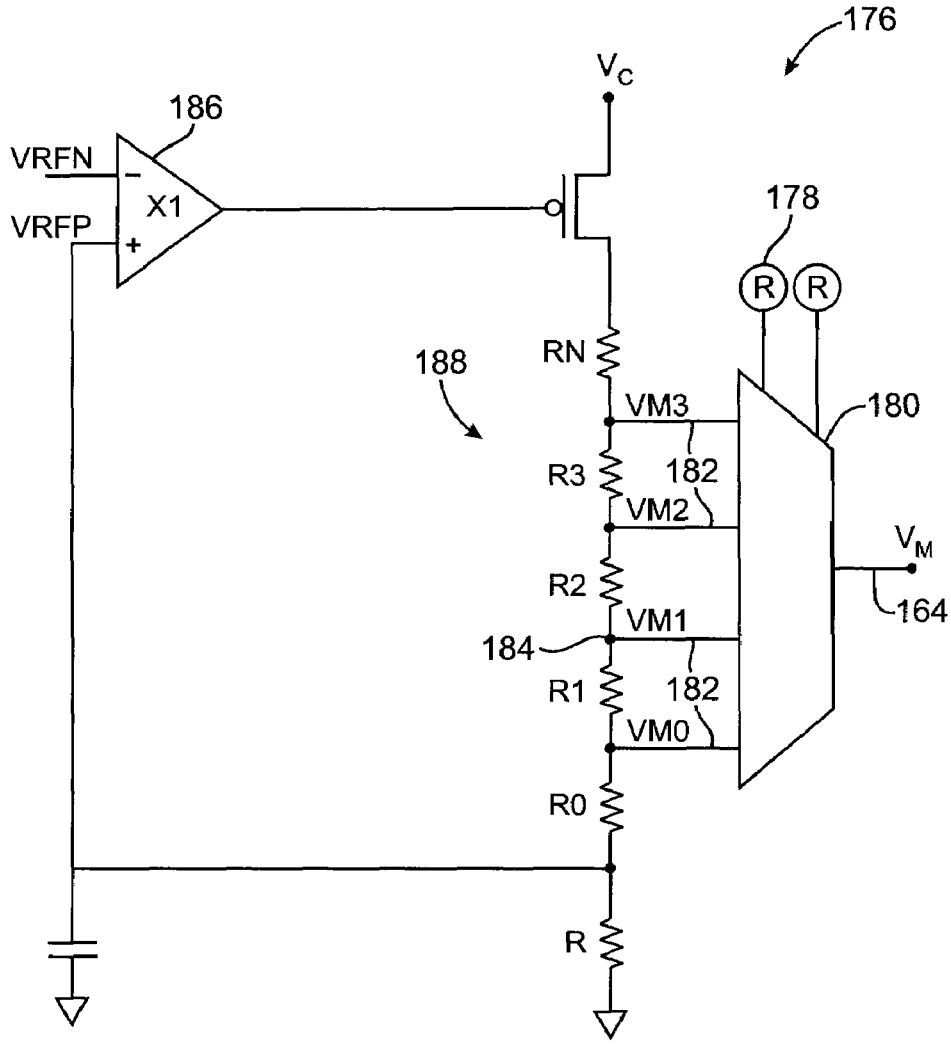
Figure 13:
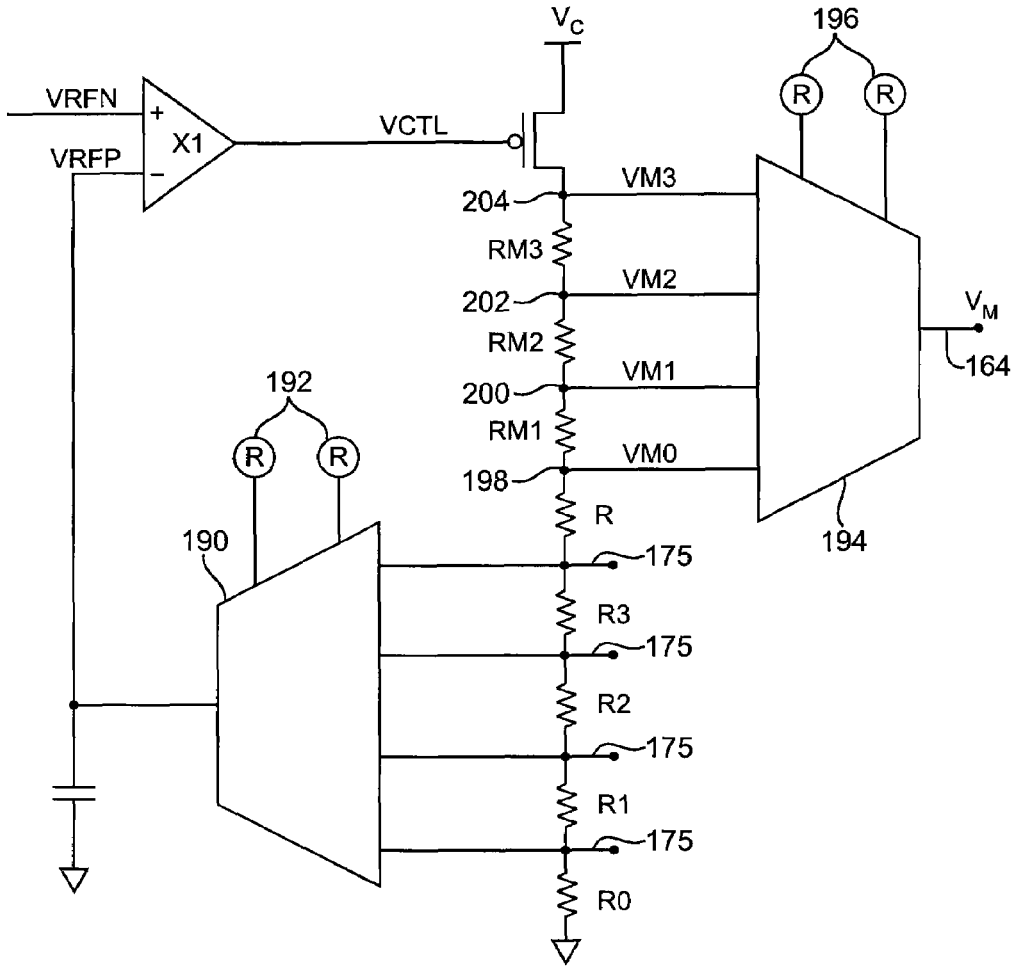

Three illustrative programmable circuits that may be used to provide programmability to circuits such as VCCEXT detection circuit 84 and local voltage regulator circuit 94 are shown in FIGS. 11, 12, and 13. FIG. 11 shows a programmable circuit that uses a multiplexer as part of an op-amp feedback path. FIG. 12 shows a programmable circuit that uses a multiplexer in selecting an output voltage from a voltage divider. FIG. 13 shows how the circuits of FIGS. 11 and 12 may be combined to form a hybrid circuit.

In illustrative programmable circuit 150 of FIG. 11, a power supply voltage VC (e.g., VCCEXT) is applied to terminal 166 and a ground voltage VSS is applied to terminals 168. A reference voltage (e.g., signal VBG on line 82 of FIG. 5) is provided to the negative input of comparator 152. A feedback signal from the output 154 of multiplexer 156 is applied to the positive input of comparator 152. The output of comparator 152 is called VCTL. If VCTL rises, transistor 170 will tend to produce a lowered current value until feedback voltage VRFP is stabilized at VRFN.

The resistors between transistor 170 and ground terminal 168 form a voltage divider circuit. Output line 164 is used to tap the voltage VM at an appropriate intermediate node in the voltage divider.

The value of VM may be programmed by adjusting the configuration of multiplexer 156. Multiplexer 156 is controlled by static control signals produced by programmable elements 158 (e.g., some of programmable elements 20 of FIG. 1). By adjusting the control signals produced by programmable elements 158, multiplexer 156 can be configured to connect any desired one of its inputs 160 to its output 154. For example, multiplexer 156 can be configured to connect the signal VR2 to output 154 by proper selection of the control bits in elements 158. In the illustrative circuit 150 of FIG. 11, there are two programmable elements 158 for controlling the selection of one of four ($2^2$) inputs to multiplexer 156. If a multiplexer with more inputs is used, more control bits may be used accordingly.

By selecting which intermediate node in the voltage regulator to feed back to comparator 152 via the feedback path connected to output 154, the output voltage VM can be controlled. If, for example, the multiplexer 156 is configured so that input VR1 is connected to output 154, the circuit 150 will stabilize in a condition in which node 172 is maintained at the reference voltage VRFN. If, as another example, the multiplexer 156 is configured so that input VR3 is connected to output 154, the circuit 150 will stabilize in a condition in which node 174 is maintained at the reference voltage VRFN. The voltage VM is connected to the same voltage divider 100, so adjusting multiplexer 156 changes VM. As an example, if node 172 is set to VRFN and if the total resistance of the resistors between ground terminal 168 and the node connected to line 164 is RT (i.e., RT=R0+R1+R2+R3+R4), the output voltage VM will be equal to VRFN*RT/(R1+R0).

As shown in FIG. 11, a number of output lines 175 may be connected to the nodes of the voltage divider 162. This allows circuit 150 to be used to produce multiple programmable outputs that rise and fall together as multiplexer 156 is adjusted. Output lines such as output lines 175 may, if desired, be used to supply the set point voltages of lines 102, 104, 106, 108, and 110 in circuit 68 of FIG. 5.

With the programmable circuit 176 of FIG. 12, the reference voltage is applied to the negative input of comparator 186 and the feedback path is connected to the positive input of comparator 186. The resistors 188 form a voltage divider. Multiplexer 180 is controlled by control bits from programmable elements 178. The multiplexer 180 can be configured by these control signals to connect any desired one of its inputs 182 to its output 164. The voltage VM at the output of circuit 176 may be controlled by selecting an appropriate configuration for multiplexer 180. For example, if the input VM1 is connected to output line 164, the output voltage VM will be equal to the voltage established at node 184 in the voltage divider. Different output voltage levels can be produced by configuring multiplexer 180 to connect a different input line to output 164.

FIG. 13 shows a hybrid arrangement that may be used for producing programmable voltages. Multiplexer 190 is controlled by control signals produced by programmable elements 192. Programmable elements 196 produce control signals for controlling multiplexer 194. With this arrangement, multiplexer 190 can be configured to connect an appropriate one of its inputs to its output. This adjusts the voltage at node 198, as described in connection with FIG. 11. The multiplexer 194 can be adjusted so that a desired one of its inputs is connected to its output. By adjusting multiplexer 194, the voltage VM at output 164 can be set to any of the voltages available on nodes 198, 200, 202, and 204. Lines 175 may be used to produce additional adjustable voltages. As multiplexer 190 is adjusted, the voltages on lines 175 (and the voltages on nodes 198, 200, 202, and 204) rise and fall in concert. Adjustments to multiplexer 194 are used to select a voltage VM independently (i.e., without affecting the voltages on lines 175).

If desired, additional multiplexers 194 may be connected to the nodes of the voltage divider of FIG. 13. Such additional multiplexers need not be connected to the same sets of nodes. For example, the inputs to each multiplexer may be staggered along the voltage divider nodes so that each multiplexer's inputs overlap, which allows their outputs to be adjusted through different ranges of possible voltages. Multiplexer inputs can also be connected to identical nodes if desired (i.e., so that they overlap without staggering). Because each multiplexer can be controlled independently, the output of each multiplexer can be set to a different voltage. Moreover, some outputs can be set to identical voltages if desired.

The adjustable circuits of FIGS. 11, 12, and 13 may be used to provide programmable set point voltages for local voltage regulator 94 of FIG. 5. By loading different sets of configuration bits into the programmable elements that control the multiplexers, different set point voltages for controlling the operation of circuits 112, 118, 131, and 136 may be produced. The adjustable circuits of FIGS. 11, 12, and 13 may also be used to provide programmable voltages for the voltage divider formed by resistors 86 in VCCEXT detection circuit. If, for example, it is desired to move the adjustable cutoff voltage from 2.8 volts to 2.9 volts (as an example), a programmable circuit can be adjusted to supply different voltages at the negative inputs to comparators 88. As another example, the adjustable circuits can be programmed to make VGP TRIP equal to TARGET VCC. With these types of arrangements, a logic designer can customize the responsiveness of the circuitry 68 to accommodate different operating environments for the programmable logic device. Adjustments can also be made to accommodate changes in desired power supply voltage levels such as changes in TARGET VCC to reflect new core-logic power supply voltages (e.g., 1.1 volts instead of 1.8 volts).

The foregoing is merely illustrative of the principles of this invention and various modifications can be made by those skilled in the art without departing from the scope and spirit of the invention.

What is claimed is:

1. A voltage regulator circuit that receives a ground voltage and an external power supply voltage and produces a core logic power supply voltage, wherein the external power supply voltage is greater than the core logic power supply voltage, comprising:

a first bus connected to the external power supply voltage;

a second bus that is maintained at the core-logic power supply voltage;

a plurality of transistors connected between the first bus and the second bus;

a local voltage regulator that produces a plurality of analog set point voltages with values which are each less than the external power supply voltage and which are each greater than the ground voltage; and control circuitry responsive to the set point voltages for controlling the transistors to maintain the second bus at the core logic power supply voltage, wherein the control circuitry monitors a voltage of the second bus.

2. The voltage regulator circuit defined in claim 1 wherein the local voltage regulator comprises circuitry for producing a target value for the core logic power supply voltage, wherein the control circuitry controls the transistors so that the core-logic power supply voltage is maintained at the target value.

3. The voltage regulator circuit defined in claim 1 wherein the set point voltages are adjustable and wherein the local voltage regulator comprises programmable circuitry that is programmed by static control signals to produce the adjustable set point voltages.

4. The voltage regulator circuit defined in claim 1 wherein the transistors comprise n-channel metal-oxide-semiconductor (NMOS) transistors, the voltage regulator circuit comprising an NMOS passgate control circuit that receives a target value for the core logic power supply voltage from the local voltage regulator and that biases the NMOS transistors in an always on configuration.

5. The voltage regulator circuit defined in claim 1 wherein the transistors comprise p-channel metal-oxide-semiconductor (PMOS) transistors, the voltage regulator circuit comprising a PMOS passgate control circuit that receives a target value for the core logic power supply voltage and at least one set point voltage having a set point value lower than the target value, wherein when the core logic power supply voltage fluctuates below the set point voltage having the set point value lower than the target value, the PMOS passgate control circuit produces control signals that turn the PMOS transistors on.

6. The voltage regulator circuit defined in claim 1 wherein the transistors comprise a first set of p-channel metal-oxide-semiconductor (PMOS) transistors and a second set of PMOS transistors and wherein the control circuitry turns the first set of PMOS transistors on when the core logic power supply voltage on the second bus drops by more than a first amount below a target value and turns the second set of PMOS transistors on when the core logic power supply voltage on the second bus drops by more than a second amount below the target value, wherein the second amount is greater than the first amount.

7. The voltage regulator circuit defined in claim 1 wherein the transistors comprise n-channel metal-oxide-semiconductor (NMOS) transistors and p-channel metal-oxide-semiconductor (PMOS) transistors, wherein the control circuitry further comprises circuitry that biases the NMOS transistors in an always on configuration and that selectively turns on and off the PMOS transistors in response to a measured value of the core logic power supply voltage on the second bus.

8. The voltage regulator circuit defined in claim 1 wherein the local voltage regulator that produces the plurality of set point voltages comprises circuitry that produces a target core logic power supply voltage set point voltage, an overshoot set point voltage that is larger than the target core logic power supply voltage set point voltage, and an undershoot set point voltage that is lower than the target core logic power supply voltage set point voltage.

9. The voltage regulator defined in claim 1 further comprising a detection circuit that receives the external power supply voltage and that produces at least one logic control signal output that indicates whether the external power supply voltage is greater or less than a reference voltage.

10. The voltage regulator defined in claim 1 further comprising a detection circuit that receives the external power supply voltage and compares the external power supply voltage to first and second voltage levels, wherein the detection circuit produces first and second logic signals that indicate whether the external power supply voltage is 1) less than both the first and second voltage levels, 2) larger than the first voltage level and less than the second voltage level, or 3) larger than both the first and second voltage levels.

11. The voltage regulator defined in claim 1 further comprising a fast ramp detection circuit that generates disable signals for the control circuitry when it is detected that the external power supply voltage rises more quickly than a threshold slew rate.

12. The voltage regulator defined in claim 1 wherein the transistors comprise n-channel metal-oxide-semiconductor (NMOS) transistors and p-channel metal-oxide-semiconductor (PMOS) transistors, the voltage regulator further comprising an overshoot control circuit that receives a core logic power supply voltage feedback signal from the second bus and that compares the core logic power supply voltage feedback signal from the second bus to an overshoot set point voltage that is greater than a desired value for the core logic power supply voltage, wherein when the overshoot control circuit detects a fluctuation in the core logic power supply voltage feedback signal that is greater than the overshoot set point voltage, the overshoot control circuit generates a signal that ensures that the PMOS transistors are turned off.

13. The voltage regulator defined in claim 1 wherein the transistors comprise n-channel metal-oxide-semiconductor (NMOS) transistors and p-channel metal-oxide-semiconductor (PMOS) transistors, the voltage regulator further comprising an undershoot control circuit that receives a core logic power supply voltage feedback signal from the second bus and that compares the core logic power supply voltage feedback signal from the second bus to an undershoot set point voltage that is less than a desired value for the core logic power supply voltage, wherein when the undershoot control circuit detects a fluctuation in the core logic power supply voltage feedback signal that undershoots the undershoot set point voltage, the undershoot control circuit generates a signal that ensures that the PMOS transistors are turned on.

14. The voltage regulator defined in claim 1 wherein the transistors comprise n-channel metal-oxide-semiconductor (NMOS) transistors, a set of helper p-channel metal-oxide-semiconductor (PMOS) transistors, and a set of supplemental helper PMOS transistors, wherein the local voltage regulator produces an OVERSHOOT TRIP set point voltage, a TARGET VCC set point voltage, a VGP TRIP set point voltage, a VGP UNDERSHOOT TRIP set point voltage, and a VGPCTL UNDERSHOOT TRIP set point voltage, wherein OVERSHOOT TRIP is greater than TARGET VCC, wherein TARGET VCC is greater than VGP TRIP, wherein VGP TRIP is greater than VGP UNDERSH monitor OOT TRIP, wherein VGP UNDERSHOOT TRIP is greater than VGPCTL UNDERSHOOT TRIP, and wherein the control circuitry comprises:

a feedback path from the second bus that the control circuitry uses to monitor the core logic power supply voltage; and a NMOS passgate control circuit that receives TARGET VCC and that produces a signal VGN that controls the NMOS transistors.

15. The voltage regulator defined in claim 14 wherein the control circuitry further comprises:

a PMOS passgate control circuit that receives VGP TRIP and VGP UNDERSHOOT TRIP and the monitored core logic power supply voltage from the feedback path and that produces a signal VGP that controls the helper PMOS transistors.

16. The voltage regulator defined in claim 15 wherein the control circuitry further comprises:

an undershoot control circuit that receives VGPCTL UNDERSHOOT TRIP and produces a signal VGPCTL that controls the supplemental helper PMOS transistors.

17. The voltage regulator defined in claim 16 further comprising:

an overshoot control circuit that receives OVERSHOOT TRIP and the monitored core logic power supply voltage from the feedback path and that provides control signals for the undershoot control circuit and the PMOS passgate control circuit.

18. The voltage regulator defined in claim 1 wherein the transistors comprise p-channel metal-oxide-semiconductor (PMOS) transistors, the voltage regulator further comprising:

a one-shot pulse generator; and a control circuit that directs the one-shot pulse generator to generate a pulse that turns on the PMOS transistors to maintain the second bus at the core logic power supply voltage and prevent undershoot in the core logic power supply voltage.

19. The voltage regulator defined in claim 1 wherein one of the set point voltages comprises an undershoot trip voltage and wherein the transistors comprise p-channel metal-oxide-semiconductor (PMOS) transistors, the voltage regulator further comprising:

a one-shot pulse generator; and a control circuit that directs the one-shot pulse generator to generate a pulse that helps to turn on the PMOS transistors to maintain the second bus at the core logic power supply voltage and prevent undershoot in the core logic power supply voltage and that directs the one-shot pulse generator to override the generation of the pulse before the pulse would otherwise terminate whenever the second bus rises past the undershoot trip set point voltage.

20. The voltage regulator defined in claim 1 wherein the transistors comprise p-channel metal-oxide-semiconductor (PMOS) transistors, the voltage regulator further comprising:

a one-shot pulse generator; and a control circuit that directs the one-shot pulse generator to generate a pulse that turns off the PMOS transistors to maintain the second bus at the core logic power supply voltage and prevent overshoot in the core logic power supply voltage.

21. The voltage regulator defined in claim 1 wherein one of the set point voltages comprises an overshoot trip set point voltage and wherein the transistors comprise p-channel metal-oxide-semiconductor (PMOS) transistors, the voltage regulator further comprising:

a one-shot pulse generator; and a control circuit that directs the one-shot pulse generator to generate a pulse that helps to turn off the PMOS transistors to maintain the second bus at the core logic power supply voltage and prevent overshoot in the core logic power supply voltage and that directs the one-shot pulse generator to override the generation of the pulse before the pulse would otherwise terminate whenever the second bus falls below the overshoot trip set point voltage.

22. An integrated circuit comprising:

core logic powered at a core logic power supply voltage level;

a first bus connected to an external power supply voltage that is greater than the core logic power supply voltage level;

a second bus;

a ring of transistors connected between the first bus and the second bus; and control circuitry that controls the ring of transistors to maintain the second bus at the core logic power supply voltage level despite changes in power consumption by the core logic by monitoring the voltage of the second bus.

23. The integrated circuit defined in claim 22 wherein the control circuitry comprises:

a bandgap reference circuit that produces a reference voltage;

a programmable circuit that provides a plurality of programmable set point voltages; and a feedback path connected to the second bus for monitoring the core logic power supply voltage level, and wherein the control circuitry produces control signals for the ring of transistors to reduce the fluctuations in the core logic power supply voltage level based on the programmable set point voltages and the monitored core logic power supply voltage level.

24. The integrated circuit defined in claim 22 wherein the programmable circuit comprises voltage divider circuitry that provides programmable overshoot and undershoot set point voltages and a target core logic power supply voltage set point voltage and wherein the control circuitry further comprises circuitry that controls the ring of transistors by comparing a measured value of the core logic power supply voltage level on the second bus to the overshoot set point voltage, the undershoot set point voltage, and the target core logic power supply voltage set point voltage.

25. The integrated circuit defined in claim 22 wherein the control circuitry further comprises:

a detection circuit that compares the external power supply voltage to a first voltage level and a second voltage level and that generates corresponding control signals; and n-channel and p-channel transistor control circuits that control the ring of transistors based at least partly on the control signals from the detection circuit.

* * * * *

UNITED STATES PATENT AND TRADEMARK OFFICE

CERTIFICATE OF CORRECTION

PATENT NO. : 7,589,584 B1
APPLICATION NO. : 11/096971
DATED : September 15, 2009
INVENTOR(S) : John Bui It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1165 days.

Signed and Sealed this

Twenty-first Day of September, 2010

David J. Kappos

David J. Kappos
*Director of the United States Patent and Trademark Office*